US010828857B2

(12) United States Patent
Wieser

(10) Patent No.: US 10,828,857 B2
(45) Date of Patent: Nov. 10, 2020

(54) ANVIL DEVICE

(71) Applicant: ELOPAK AS, Spikkestad (NO)

(72) Inventor: Martin Kurt Wieser, Vettre (NO)

(73) Assignee: ELOPAK AS, Spikkestad (NO)

( * ) Notice: Subject to any disclaimer, the term of this patent is extended or adjusted under 35 U.S.C. 154(b) by 123 days.

(21) Appl. No.: 16/311,241

(22) PCT Filed: Jul. 4, 2017

(86) PCT No.: PCT/EP2017/066680
§ 371 (c)(1),
(2) Date: Dec. 19, 2018

(87) PCT Pub. No.: WO2018/007407
PCT Pub. Date: Jan. 11, 2018

(65) Prior Publication Data

US 2019/0193363 A1 Jun. 27, 2019

(30) Foreign Application Priority Data

Jul. 5, 2016 (GB) ..... 1611673.3

(51) Int. Cl.

| | |
|---|---|
| ***B65B 7/18*** | (2006.01) |
| ***B65B 43/24*** | (2006.01) |
| ***B31B 50/28*** | (2017.01) |
| ***B65B 3/02*** | (2006.01) |
| ***B31B 50/59*** | (2017.01) |
| *B31B 110/35* | (2017.01) |
| *B31B 100/00* | (2017.01) |

(52) U.S. Cl.
CPC ..... *B31B 50/28* (2017.08); *B31B 50/594* (2018.05); *B65B 3/025* (2013.01); *B65B 7/18* (2013.01); *B31B 2100/0022* (2017.08); *B31B 2110/35* (2017.08)

(58) Field of Classification Search
CPC ..... B65B 7/18; B65B 43/24
See application file for complete search history.

(56) References Cited

U.S. PATENT DOCUMENTS

| | | | | |
|---|---|---|---|---|
| 2,969,002 A | | 1/1961 | Gunther | |
| 3,120,089 A | * | 2/1964 | Egleston | B29C 65/10 53/565 |

(Continued)

FOREIGN PATENT DOCUMENTS

| | | | |
|---|---|---|---|
| EP | 0597355 | A2 | 5/1994 |
| WO | 2003086881 | A1 | 10/2003 |
| WO | 2015067661 | A1 | 5/2015 |

*Primary Examiner* — Andrew M Tecco
*Assistant Examiner* — Eyamindae C Jallow
(74) *Attorney, Agent, or Firm* — Burns & Levinson LLP; Bruce D. Jobse

(57) ABSTRACT

An anvil device (10) is for insertion into an end closure of a partially formed container. The anvil device (10) comprises a bracket (12) and an anvil body (14) connected to one end of the bracket (12). The anvil body (14) comprises four corners (C1 to C4) where the distance between one pair of diagonally opposite corners (C1, C3) is less than the distance between the other pair of diagonally opposite corners (C2, C4). The anvil body (14) is asymmetric and one corner (C1) is closer to the centre of the anvil body (14) than each of the other three corners (C2 to C4).

20 Claims, 8 Drawing Sheets

(56) References Cited

U.S. PATENT DOCUMENTS

Figure 1:
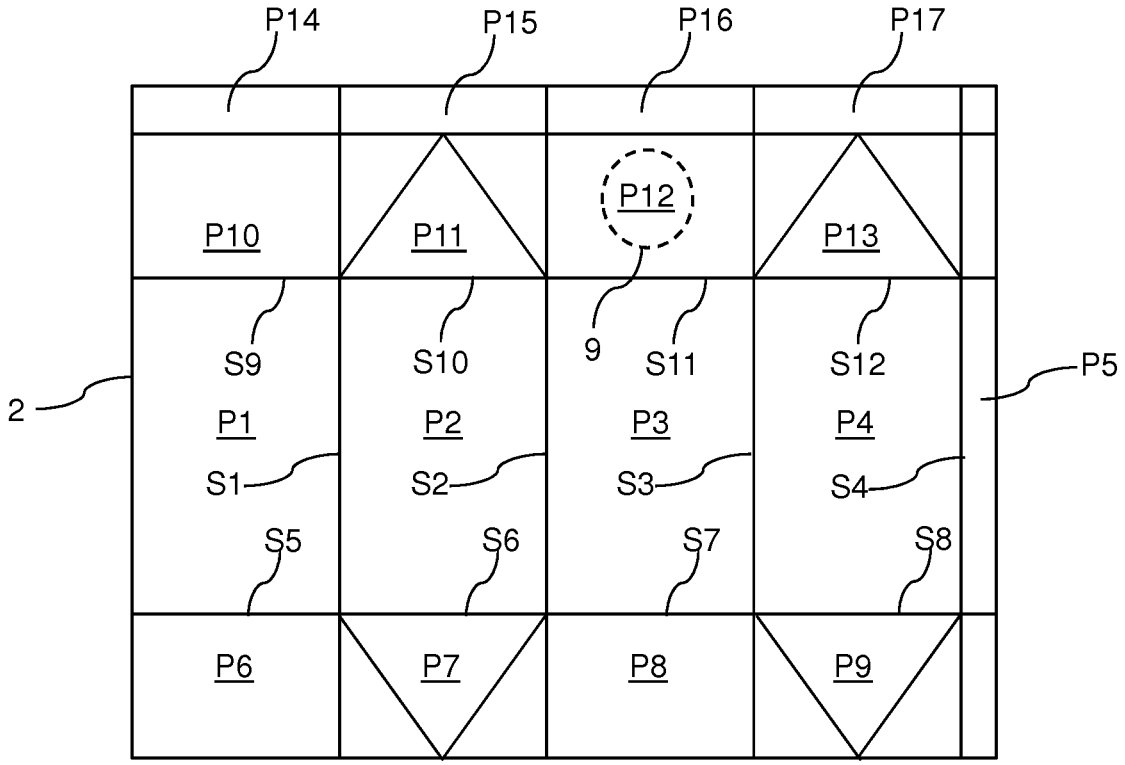

| | | | | | |
|---|---|---|---|---|---|
| 4,044,656 | A * | 8/1977 | Vetten | B65B 7/18 | 493/163 |
| 4,135,439 | A * | 1/1979 | Murrah | B65B 43/24 | 493/453 |
| 5,350,568 | A * | 9/1994 | Tuckner | B65B 55/10 | 422/300 |
| 5,639,432 | A * | 6/1997 | Carlson | B65B 55/10 | 422/302 |
| 6,339,914 | B1 * | 1/2002 | Fujikawa | B65B 43/24 | 493/165 |
| 6,343,460 | B1 * | 2/2002 | Fujikawa | B65B 3/025 | 493/184 |
| 10,676,232 | B2 * | 6/2020 | Wieser | B65B 3/025 | |
| 2016/0297163 | A1 * | 10/2016 | Wieser | B65B 7/18 | |

* cited by examiner

ANVIL DEVICE

This invention relates to an anvil device and to a method of using the anvil device in the formation of an end closure of a partially formed container.

Anvil devices are used on form-fill-seal packaging machines that are used to create milk cartons, for example. A flat blank of laminated cardboard with various scorelines is sealed along one edge to form a sleeve and one end of this sleeve is then sealed to create a bottom end closure. The partially formed container is then filled and top sealed into either a gable top carton or a flat top carton. During the top sealing stage of the process, the scorelines that are present on the partially formed container in relation to the top end closure are pre-broken either before or after the partially formed container is filled. This stage comprises lowering an anvil device into the partially formed container and applying external pressure against the partially formed container's top end closure region.

International Patent Application Publication WO 2015/067661 discloses an example of an anvil device. Apparatus including a forming anvil device for insertion into an end closure region of a partially formed container is disclosed, the anvil device comprising a front edge region, a rear edge region, respective lateral edge regions extending between the front and rear edge regions and first and second forming portions each having a corner-forming zone including at the respective rear edge region and a lateral edge region arranged substantially orthogonal to each other, each lateral edge region, extending away from the corner-forming zone and towards the front edge region, also including an obliquely inwardly arranged portion.

It is an object of the invention to improve upon the known art.

According to a first aspect of the present invention, there is provided an anvil device for insertion into an end closure of a partially formed container, the anvil device comprising a bracket, and an anvil body connected to one end of the bracket, the anvil body comprising four corners, the distance between one pair of diagonally opposite corners being less than the distance between the other pair of diagonally opposite corners, characterised in that one corner is closer to the centre of the anvil body than each of the other three corners.

According to a second aspect of the present invention, there is provided a method of forming an end closure of a partially formed container, the method comprising the steps of receiving the partially formed container, inserting into an opening of the end closure an anvil device comprising a bracket, and an anvil body connected to one end of the bracket, the anvil body comprising four corners, the distance between one pair of diagonally opposite corners is less than the distance between the other pair of diagonally opposite corners, wherein one corner is closer to the centre of the anvil body than each of the other three corners, and pressing externally on the end closure of the partially formed container.

Owing to the invention, it is possible to provide an anvil device that can be used on a form-fill-seal machine, where the anvil device is asymmetrical in design. The anvil body of the anvil device is asymmetric in the sense that the distance between diagonally opposite corners of the anvil body is not the same for both pairs of corners, when viewed from above, the anvil body forms a quadrilateral that is not square, with one corner being closer to the centre of the anvil body than the other three corners. The principal advantage of the design of the anvil device is that the asymmetric shape of the anvil body can be closely fitted into the open top end of the partially formed container without the likelihood of catching on the upright sides of the partially formed container.

The anvil body, when viewed from below can be formed in a number of different shapes, such as H-shaped, X-shaped or U-shaped. Each of these shapes can be configured so that there are four corners to the anvil body that match the four corners of the open partially formed container into which the anvil body is being inserted. Whichever shape is used, the distances between the diagonally opposite corners are not the same, with one corner closer to the centre of the shape formed by the anvil body than the other three corners, thereby providing the asymmetry that delivers the improved performance of the anvil device, with respect to partially formed containers that are not completely uniform.

The partially formed container, in one embodiment, is a sleeve formed from a flat blank that has been folded and sealed on one edge and at the bottom. When viewing the partially formed container from above, the shape of the open top closure will initially be viewed as being square in shape but in fact owing to the memory in the material used for the carton blank (primarily the cardboard substrate), the open top closure part will actually tend towards a non-square quadrilateral (i.e. slightly diamond-shaped). This means that a completely square anvil body that is designed to match very closely in size to the size of the opening within the partially formed container will tend to catch on the non-square shape of the opening.

The asymmetric anvil body is designed so that the anvil body will fit is closely to the internal shape of the partially formed container when introduced into that partially formed container, but without the danger that a slightly non-square partially formed container opening will catch on the anvil body as the anvil body is lowered into the partially formed container during the top panel breaking stage. The anvil body, in one embodiment, is itself slightly diamond-shaped, and this corrects for any deformation that occurs in the partially formed container owing to the material memory which is tending to pull the sleeve of the partially formed container away from a true square cross-section.

Preferably, the anvil body is H-shaped and the bracket is connected to the anvil body in a central region of the anvil body. The anvil body is H-shaped when viewed from above or below, with the ends of the H-shape corresponding to the four corners of the anvil body. The asymmetry in the design of the anvil body is provided by one of the upright "legs" of the H-shapes being shorter than the other upright "leg", which leads to the diagonal distance between one pair of diagonally opposite corners being less than the distance between the other pair of diagonally opposite corners.

Advantageously, a first pair of adjacent corners of the anvil body are directly connected by a substantially straight first edge and a second pair of adjacent corners of the anvil body are directly connected by a second edge. The length of the first edge directly connecting the first pair of adjacent corners of the anvil body is longer than the length of the second edge directly connecting the second pair of adjacent corners of the anvil body. Each pair of adjacent corners can be directly connected by a continuous edge, which in one case will be substantially straight and in the other case will be substantially straight along only some of the length of the edge. This design of the anvil body leads to the corner on the shorter edge being in a position that leads to the overall slight diamond-shape of the anvil body, when viewed from above or below, in order to match the slightly diamond-shape that may occur in the open sleeve of the open partially formed container.

Ideally, the three corners further from the centre of the anvil body than the one corner are all equidistant from the centre of the anvil body. In the preferred embodiment of the anvil body, the four corners of the anvil body form a quadrilateral, with one of the corners closer to the centre of the quadrilateral and the other three corners equidistant from the centre of the quadrilateral. This defines a shape that is asymmetrical. The centre of the anvil body is defined as the meeting point of two lines drawn through opposite corners of the anvil body. This shape of anvil body provides the best fit to the outline of the partially formed container while also delivering the advantage of compensating for any small misshape in the opening of the partially formed container.

Embodiments of the present invention will now be described, by way of example only, with reference to the accompanying drawings, in which:—

Figure 2:
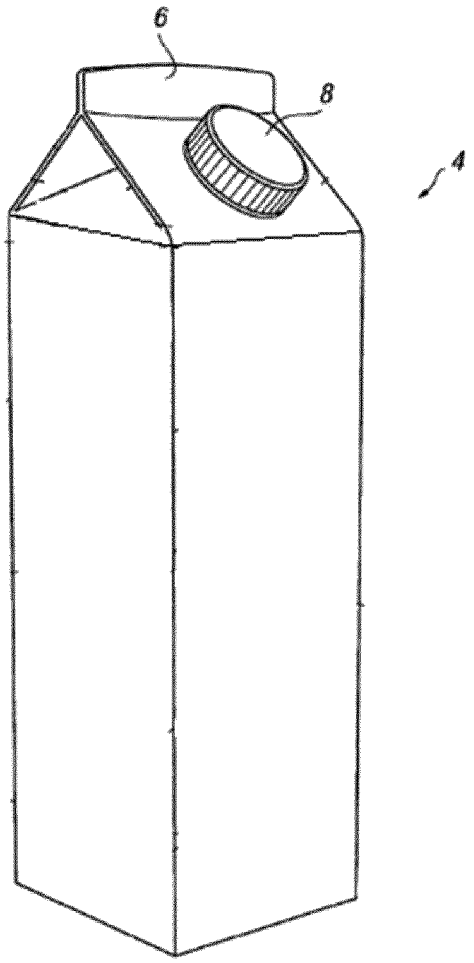
Figure 3:
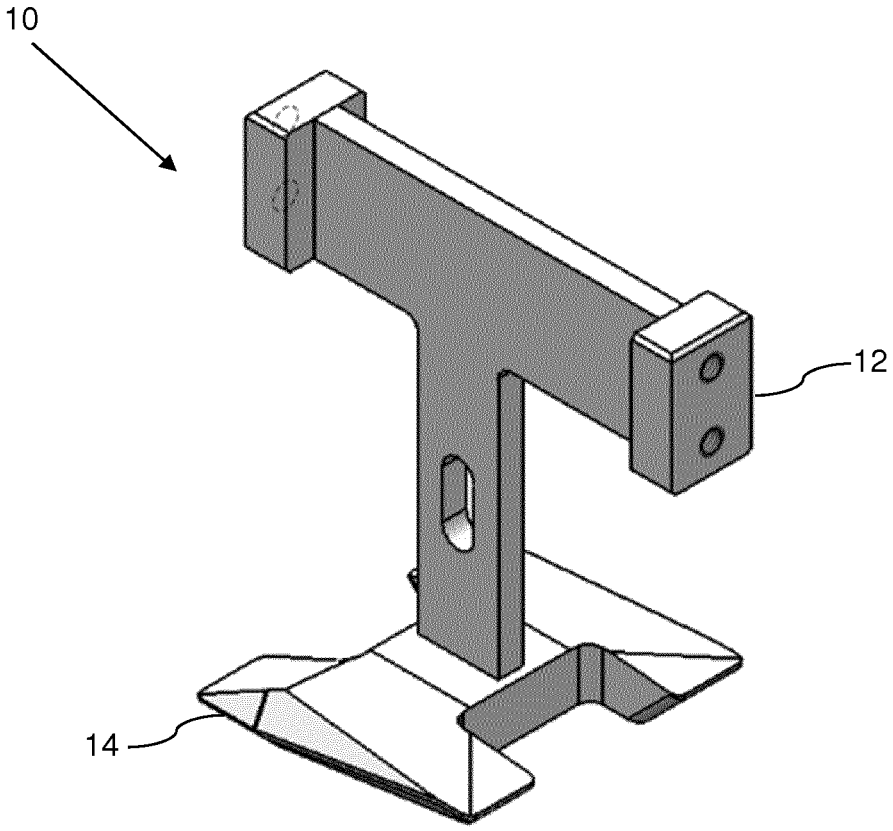
Figure 4:
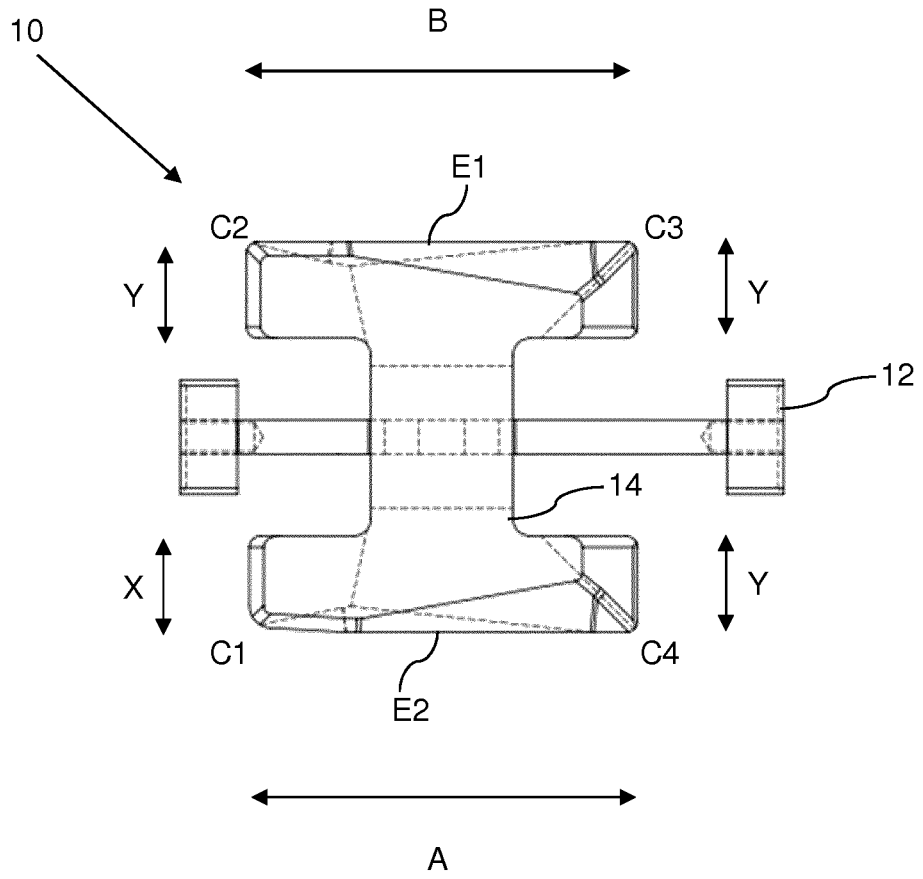
Figure 5:
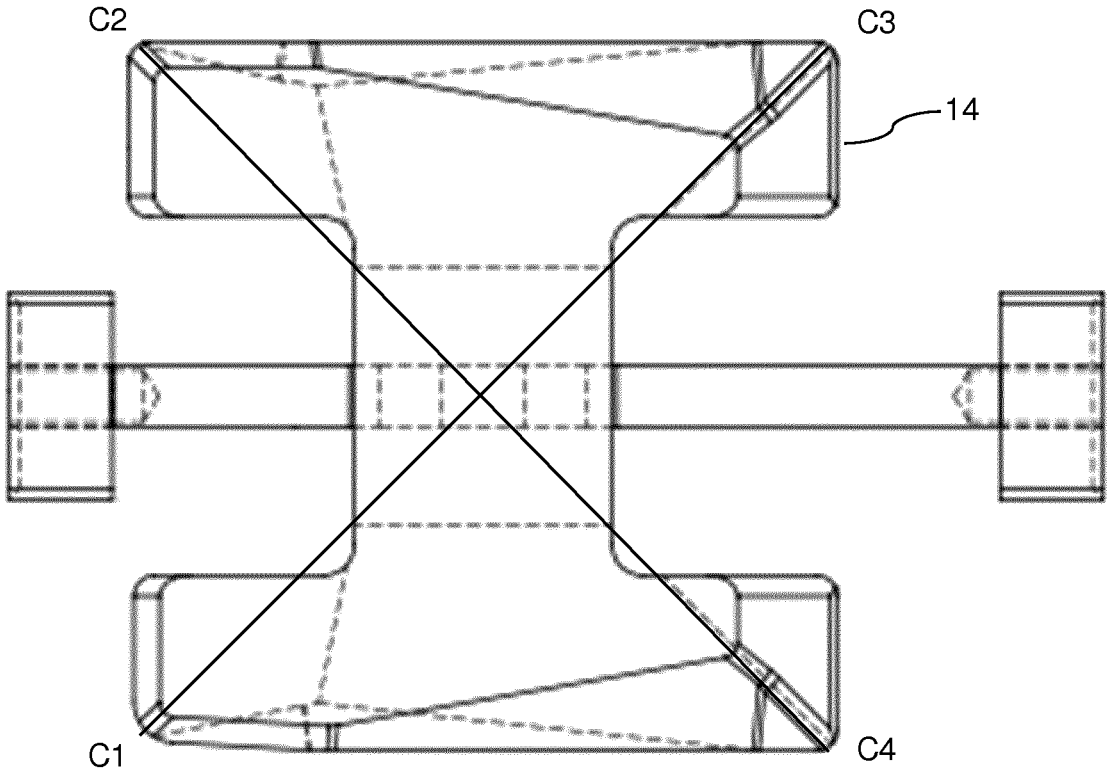
Figure 6:
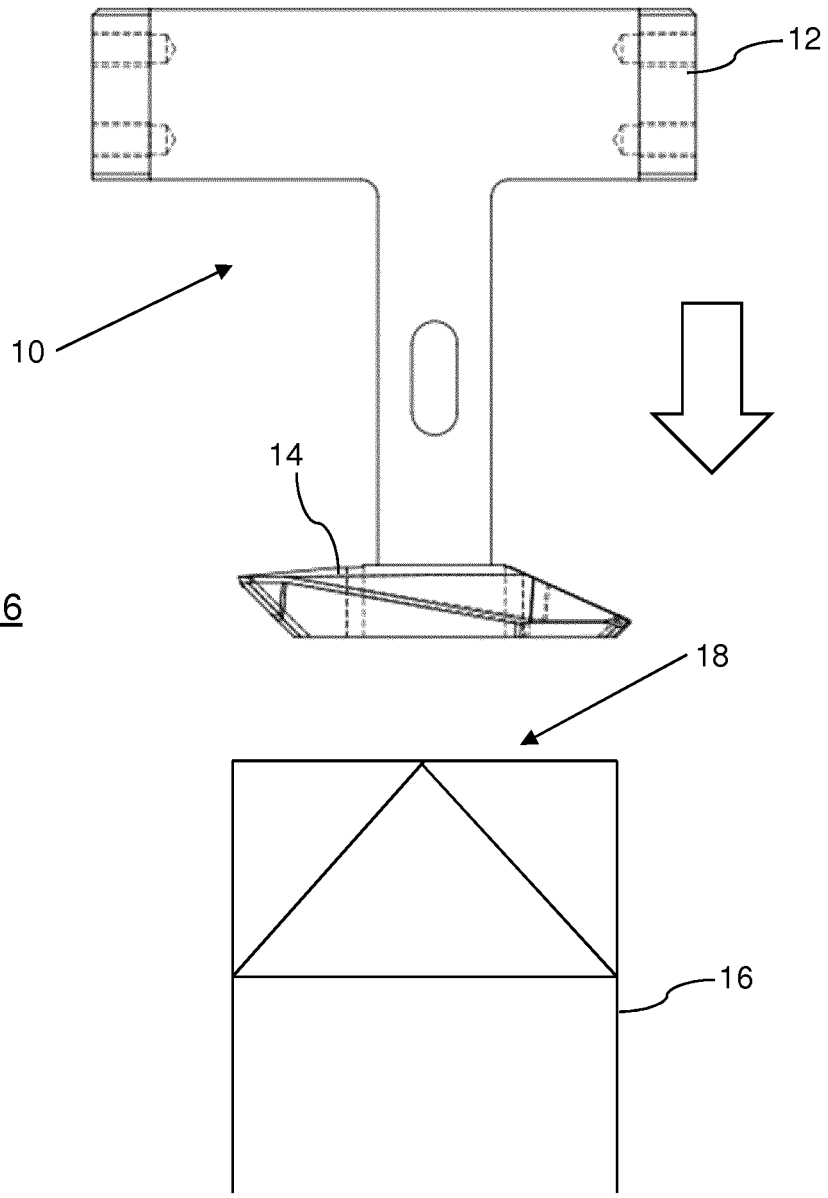
Figure 7:
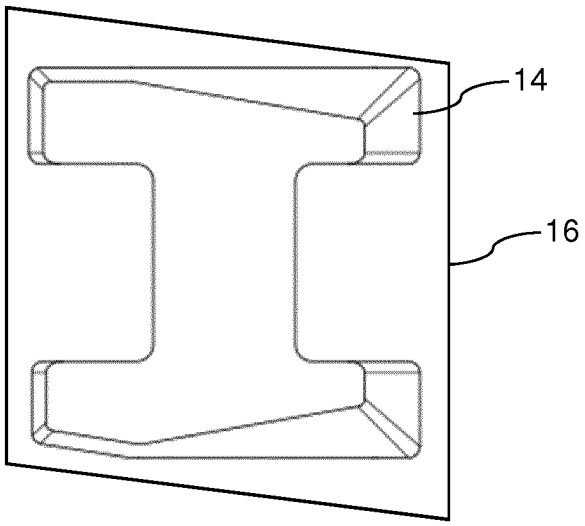
Figure 8:
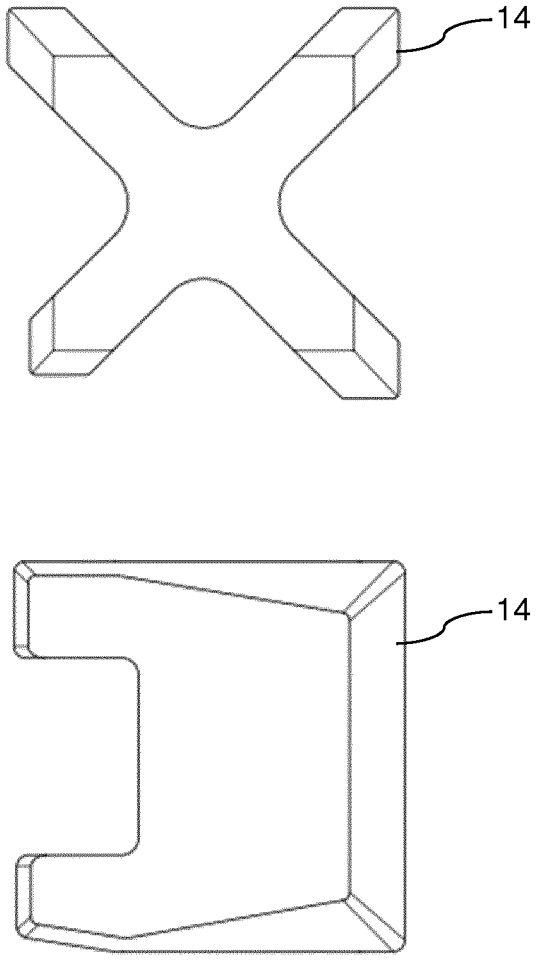

FIG. 1 is a plan view of a container blank,

FIG. 2 is a perspective view of a sealed and filled container constructed from the container blank, FIG. 3 is a perspective view from above of an anvil device, FIG. 4 is a view from below of the anvil device, FIG. 5 is an enlarged view from below of the anvil device, FIG. 6 is a side view of the anvil device and a partially formed container, FIG. 7 is a view from below of the anvil device and the partially formed container, and FIG. 8 is a view from below of two further embodiments of the anvil device.

Referring to FIG. 1, a container blank 2 consists of a laminate consisting of at least a paperboard substrate layer and innermost and outermost layers of a moisture barrier thermoplastics (with the possible interposition of an oxygen barrier layer such as aluminium foil between the substrate and the innermost thermoplastics layer) and the container 4 formed therefrom shown in FIG. 2 is used for packaging liquids, for example milk or fruit juice. The blank 2 consists of four body sub-panels P1 to P4 with a fifth sealing panel P5, bounded by pre-formed lines of weakness in the form of scorelines S1 to S4 there among.

The body sub-panels P1 to P4 are bounded at their lower edges by further lines of weakness in the form of scorelines S5 to S8 and thereby divided from a row of bottom end closure panels P6 to P9. The body sub-panels P1 to P4 are also bounded at their upper edges by further lines of weakness in the form of score lines S9 to S12 and thereby divided from a row of top obturating sub-panels P10 to P13. The panels P10 and P12 are quadrangular and form respective quadrangular roof panels of the gable-topped container 4, whilst the sub-panels P11 and P13 are quadrangular and each divided by respective oblique scorelines into three substantially triangular sub-sub-panels.

The row of top obturating panels P10 to P13 are bounded at their upper edges by a row of top-sealing panels P14 to P17 to form a sealing fin 6 of the carton 4. In addition, a pour spout fitment 8 is applied either to the outside or the inside of the laminate of the sub-panel P12 over or through a loop of weakness 9.

The process of converting the container blank 2 of FIG. 1 to the container 4 of FIG. 2 begins with sealing the fifth panel P5 to the inside surface of panel P1 and folding along the score line S2 to form a flat container sleeve open at both ends. The flat container sleeves are then loaded into a packaging machine, usually a so-called form-fill-seal machine. The packaging machine comprises a plurality of mandrels fixed to a rotary hub which is rotated stepwise about its own axis. The mandrels are equi-angularly spaced about the axis, and in turn receive opened container sleeves; the sleeves in turn have the bottom end closure panels folded-in; in turn have a hot end press applied to the outer surface of the bottom end closures, to heat- and pressure-seal the bottom end closure panels together; the sealed bottom end closures being cooled on the mandrels and in turn the container sleeves, now closed at one end, are removed from the mandrels into pockets of a linear conveyor.

In order for the top obturating sub-panels P10 to P13 to be closed and sealed to form a top end closure, the scorelines on and adjacent these panels P10 to P13 need to be broken or activated to make the sealing process easier to complete. The scorelines S9 to S12 are broken to assist in the formation of the top obturating sub-panels. The scorelines S9 to S12 are broken with the assistance of a forming anvil device 10 shown in FIG. 3 (in perspective from above and FIG. 4 (from below).

Referring to FIGS. 3 and 4, the anvil device 10 comprises a bracket 12 for connecting at one end to the packaging machine by way of a fixing pin or the like. At the opposite end of the bracket 12 a solid anvil body 14 is located. The anvil device 10 comprises a bracket 12 and an anvil body 14 connected to one end of the bracket 12. The anvil body 14 comprises four corners C1 to C4 (see FIG. 4) where the distance between one pair of diagonally opposite corners C1 and C3 is less than the distance between the other pair of diagonally opposite corners C2 and C4, the corner C1 being located closer to the centre of the anvil body 14 than the other three corners C2 to C4. The anvil body 14 is asymmetrical in relation to the perimeter of the body 14 defined by the four corners C1 to C4. The four corners C1 to C4 lie in the same plane, which is a horizontal plane, when the anvil device 10 is in use.

FIG. 3 shows a perspective view of the anvil device 10 viewed from above. The bracket 12 connects at one end to the packaging machine that is forming, filling and sealing the partially formed containers and connects at the other end to the anvil body 14, which performs the breaking of the various scorelines that are used when the top closure is formed and sealed after the partially formed container has been filled. The H-shaped anvil body 14 is shaped to largely follow the square shape that is made by the opening of the partially formed container, with the exception that the anvil body 14 is actually asymmetric in its shape, which is described in more detail below, particularly with reference to FIGS. 4 and 5.

The anvil body 14 is asymmetrical in design to compensate for any slightly non-square shape to the opening of the partially formed container into which the anvil body 14 is actually being inserted. Since the partially formed container has been formed from a flat blank 2 that has been folded and sealed into a sleeve, with the bottom sealed ready to receive the contents, the sleeve will tend towards a slight diamond-shape, rather than a true square. The H-shaped anvil body 14 is thus slightly non-square in order to ensure that anvil body 14 can be fitted into the non-square opening without the risk of catching on the sealed sleeve.

FIG. 4 shows a view of the anvil device 10 from below, showing clearly the formation of the anvil body 14 from underneath. The anvil body 14 is H-shaped and the bracket 12 is connected to the anvil body 14 in a central region of the anvil body 14. A first pair of adjacent corners C2 and C3 of the anvil body 14 are directly connected by a substantially straight first edge E1. A second pair of adjacent corners C1 and C4 of the anvil body 14 are directly connected by a second edge E2, which is straight along a majority of its length, but is formed from two straight edges at a large obtuse (near 180 degrees) angle to each other. The two opposite edges E1 and E2 are parallel along those parts that form their central portions and in the regions from the centre to the respective corners C3 and C4. The edge E2 is formed by two straight lines forming an obtuse angle.

The length of the first edge E1 directly connecting the first pair of adjacent corners C2 and C3 of the anvil body 14 is longer than the length of the second edge E2 directly connecting the second pair of adjacent corners C1 and C4 of the anvil body 14. This difference in length provides the asymmetry in the design of the anvil body 14 and ensures that the distance between the corners C1 and C3 is less than the distance between the corners C2 and C4, resulting in a very slightly non-square shape to the overall design of the anvil body 14 when viewed from below, as in FIG. 4.

The distance A from corner C1 to C4 is less than the distance B from corner C2 to C3 and the distance X is less than the corresponding distance Y on each of the individual corners. The corner C1 is closer to the centre of the anvil body 14 than each of the other corners C2 to C4. This effectively gives the profile of the anvil body 14 (in relation to the location of the four corners C1 to C4) a diamond-like shape rather than a true square, and this asymmetry compensates for any deviation in the opening of the partially formed container when that container is in the sleeve form prior to the top forming panels being broken in a pre-breaking stage. The combination of distances shown in FIG. 4 can be characterised as XYYY, with one short edge and three longer edges. Other combinations of distances are possible, as long as the overall asymmetry of the anvil body 14 is maintained.

FIG. 5 illustrates more clearly the physical property of the anvil body 14 in relation to the corner C1 being closer to the centre of the anvil body 14 than each of the other corners C2 to C4. The three corners C2 to C4 further from the centre of the anvil body 14 than the one corner C1 are all equidistant from the centre of the anvil body. The four corners C1 to C4 of the anvil body 14 form a quadrilateral, with the corner C1 closer to the centre of the quadrilateral and the other three corners C2 to C4 equidistant from the centre of the quadrilateral. This defines a shape that is asymmetrical. The centre of the anvil body 14 is defined as the meeting point of two lines drawn through opposite corners of the anvil body 14. This shape of anvil body 14 provides the best fit to the outline of the partially formed container while also delivering the advantage of compensating for any small misshape in the opening of the partially formed container.

FIG. 6 shows a side view of the anvil device 10 in position ready to be lowered inside a partially formed container 16. The forming anvil device 10 is lowered into the open ended top closure region 18 of the partially formed container 16 to a position that is in line with the scorelines of the top closure section. The packaging machine at this point receives the partially formed container 16, inserts into an opening 18 of the end closure the anvil device 10 and presses externally on the end closure of the partially formed container 16. The bracket 12 mounts the anvil body 14 of the anvil device 10, and the anvil body 14 is used to provide a surface internally within the partially formed container 16 to be pressed against in this forming step.

FIG. 7 shows the bottom of the anvil body 14 of the anvil device, located within a partially formed container 18. Here the sleeve that forms the partially formed container 18 is shown in a diamond arrangement, exaggerated to show the effect of the sleeve tending to push back into the diamond shape rather than staying truly square. The asymmetry of the anvil body 14 mitigates the risk of the anvil body 14 catching against the partially formed container 18 as the anvil body 14 is lowered into the partially formed container 18 as part of the top breaking forming step of the construction of the finished container 4 of FIG. 2.

FIG. 8 shows two further embodiments of the anvil device 10, shown from below to illustrate the shape of the anvil body 14. The first anvil device 10 shown in the Figure has an X-shaped body 14 and the second anvil device 10 shown in the Figure has a U-shaped body 14. In both alternative embodiments, the anvil device 10 has a bracket 12 that mounts the anvil body 14, as per FIG. 5, for example. In both alternative anvil bodies 14 the asymmetry is maintained, with one of the diagonal distances from corner to corner being less than the other diagonal distance from corner to corner, and one corner closer to the centre of the anvil body 14 than the other three corners, which are all equidistant from the centre of the anvil body 14. As before, the four corners of the anvil bodies 14 lie in the same plane, which is horizontal during top breaking.

The invention claimed is:

1. An anvil device (10) for insertion into an end closure of a partially formed container (16), the anvil device (10) comprising:

bracket (12), and an anvil body (14) connected to one end of the bracket (12), the anvil body (14) comprising four corners (C1-C4), the distance between one pair of diagonally opposite corners (C1, C3) being less than the distance between the other pair of diagonally opposite corners (C2, C4), characterized in that one corner (C1) is closer to the center of the anvil body (14) than each of the other three corners (C2, C3, C4).

2. An anvil device according to claim 1, wherein the anvil body (14) is H-shaped and the bracket (12) is connected to the anvil body (14) in a central region of the anvil body (14).

3. An anvil device according to claim 2, wherein a first pair of adjacent corners of the anvil body are directly connected by a substantially straight first edge.

4. An anvil device according to claim 2, wherein a second pair of adjacent corners of the anvil body are directly connected by a second edge.

5. An anvil device according to claim 2, wherein the three corners further from the center of the anvil body than the one corner are all equidistant from the center of the anvil body.

6. An anvil device according to claim 1, wherein a first pair of adjacent corners (C2, C3) of the anvil body (14) are directly connected by a substantially straight first edge (E1).

7. An anvil device according to claim 6, wherein the length of the first edge (El) directly connecting the first pair of adjacent corners (C2, C3) of the anvil body (14) is longer than the length of the second edge (E2) directly connecting the second pair of adjacent corners (C1, C4) of the anvil body (14).

8. An anvil device according to claim 1, wherein a second pair of adjacent corners (C1, C4) of the anvil body (14) are directly connected by a second edge (E2).

9. An anvil device according to claim 8, wherein the length of the first edge directly connecting the first pair of adjacent corners of the anvil body is longer than the length of the second edge directly connecting the second pair of adjacent corners of the anvil body.

10. An anvil device according to claim 1, wherein the three corners (C2, C3, C4) further from the center of the anvil body (14) than the one corner (C1) are all equidistant from the center of the anvil body (14).

11. A method of forming an end closure of a partially formed container (1 6), the method comprising:

receiving the partially formed container (16), inserting into an opening of the end closure an anvil device (10) comprising a bracket (12), and an anvil body (14) connected to one end of the bracket (12), the anvil body (14) comprising four corners (C1-C4), the distance between one pair of diagonally opposite corners (C1, C3) being less than the distance between the other pair of diagonally opposite corners (C2, C4), wherein one corner (C1) is closer to the center of the anvil body (14) than each of the other three corners (C2, C3, C4), and pressing externally on the end closure of the partially formed container (16).

12. A method according to claim 11, wherein the anvil body (14) is H-shaped and the bracket (12) is connected to the anvil body (14) in a central region of the anvil body (14).

13. A method according to claim 12, wherein a first pair of adjacent corners of the anvil body are directly connected by a substantially straight first edge.

14. A method according to claim 12, wherein a second pair of adjacent corners of the anvil body are directly connected by a second edge.

15. A method according to claim 12, wherein the three corners further from the center of the anvil body than the one corner are all equidistant from the center of the anvil body.

16. A method according to claim 11, wherein a first pair of adjacent corners (C2, C3) of the anvil body (14) are directly connected by a substantially straight first edge (E1).

17. A method according to claim 16, wherein the length of the first edge (E1) directly connecting the first pair of adjacent corners (C2, C3) of the anvil body (14) is longer than the length of the second edge (E2) directly connecting the second pair of adjacent corners (C1, C4) of the anvil body (14).

18. A method according to claim 11, wherein a second pair of adjacent corners (C1, C4) of the anvil body (14) are directly connected by a second edge (E2).

19. A method according to claim 18, wherein the length of the first edge directly connecting the first pair of adjacent corners of the anvil body is longer than the length of the second edge directly connecting the second pair of adjacent corners of the anvil body.

20. A method according to claim 11, wherein the three corners (C2, C3, C4) further from the center of the anvil body (14) than the one corner (C1) are all equidistant from the center of the anvil body (14).

* * * * *